US007048516B2

(12) United States Patent
Maier et al.

(10) Patent No.: US 7,048,516 B2
(45) Date of Patent: May 23, 2006

(54) HIGH PRESSURE FUEL PUMP WITH MULTIPLE RADIAL PLUNGERS

(75) Inventors: Eugen Maier, Clarkston, MI (US); Michael Raymond Raney, Mendon, NY (US)

(73) Assignee: Delphi Technologies, Inc., Troy, MI (US)

( * ) Notice: Subject to any disclaimer, the term of this patent is extended or adjusted under 35 U.S.C. 154(b) by 377 days.

(21) Appl. No.: 10/457,273

(22) Filed: Jun. 9, 2003

(65) Prior Publication Data

US 2004/0247470 A1 Dec. 9, 2004

(51) Int. Cl.
*F04B 1/04* (2006.01)
*F04B 27/04* (2006.01)

(52) U.S. Cl. ..... 417/273; 417/486

(58) Field of Classification Search ..... 417/273, 417/486, 487, 307, 308, 440
See application file for complete search history.

(56) References Cited

U.S. PATENT DOCUMENTS

| | | | | | |
|---|---|---|---|---|---|
| 3,267,861 | A | * | 8/1966 | Jean et al. | 417/462 |
| 4,846,631 | A | * | 7/1989 | Parrott | 417/273 |
| 4,889,096 | A | * | 12/1989 | Brunel | 123/450 |
| 5,090,295 | A | * | 2/1992 | Cunningham et al. | 91/491 |
| 5,215,449 | A | * | 6/1993 | Ilija | 417/462 |
| 5,228,844 | A | * | 7/1993 | Klopfer et al. | 417/440 |
| 5,318,001 | A | | 6/1994 | Djordjevic | |
| RE34,956 | E | * | 5/1995 | Djordjevic | 417/462 |
| 5,592,920 | A | * | 1/1997 | Fehlmann | 123/450 |
| 5,746,584 | A | * | 5/1998 | Nakamura et al. | 417/273 |
| 5,850,817 | A | * | 12/1998 | Bouchauveau et al. | 123/458 |
| 6,041,760 | A | * | 3/2000 | Fehlmann et al. | 123/502 |
| RE37,632 | E | | 4/2002 | Bouchauveau et al. | |
| 6,447,263 | B1 | | 9/2002 | Cooke et al. | |
| 6,651,625 | B1 | | 11/2003 | Knight et al. | |

FOREIGN PATENT DOCUMENTS

DE 101 15 167 12/2002

OTHER PUBLICATIONS

Copy of EP Search Report dated Aug. 30, 2004.

* cited by examiner

*Primary Examiner*—William H. Rodriguez
(74) *Attorney, Agent, or Firm*—Jimmy L. Funke

(57) ABSTRACT

A fuel pump for supplying fuel at high fuel pressures includes a stationary body having a plurality of radial cylinders connecting with a central fuel chamber. Inlet and outlet passages communicate with the fuel chamber. Plungers are reciprocated in the cylinders by cam followers reciprocable in follower recesses of the body. A rotary internal cam engages the cam followers and is configured to reciprocate the plungers in timed relation to sequentially draw fuel from the inlet passage into the central fuel chamber and alternately force fuel from the central fuel chamber to the outlet passage in response to rotation of the rotary cam. A preferred embodiment includes paired smaller and larger diameter cylinders and pistons which are sequentially actuated in overlapping fashion to minimize pulsing of the pressurized fuel discharged from the pump into associated engine fuel lines.

17 Claims, 5 Drawing Sheets

HIGH PRESSURE FUEL PUMP WITH MULTIPLE RADIAL PLUNGERS

TECHNICAL FIELD

This invention relates to high pressure fuel pumps and, more particularly, to pumps having inwardly pumping radial plungers.

BACKGROUND OF THE INVENTION

It is known in the art relating to high pressure fuel pumps to use close fitting reciprocating plungers to provide efficient pumping members suitable for developing high fuel pressures for direct injection of fuel into engine combustion chambers. Such pumps are widely used in diesel engines for direct injection of fuel at high cylinder pressures for compression ignition of the fuel. However diesel fuel has relatively high lubricity, higher viscosity and other characteristics which differ from current automotive gasoline for use in spark ignition engines. It was desired to develop a high pressure plunger fuel pump suitable for use with spark ignition or dual mode engines to inject gasoline and similar fuels directly into engine combustion chambers for ignition and burning.

SUMMARY OF THE INVENTION

The present invention provides a fuel pump for supplying fuel at high fuel pressures, the pump including a stationary body having a plurality of radial cylinders connecting inwardly with a central fuel chamber. Inlet and outlet passages communicate with the fuel chamber for admitting and discharging fuel from the chamber. Plungers are reciprocable in the cylinders and connect outwardly with cam followers reciprocable in follower recesses of the body.

A rotary internal cam engages the cam followers and is rotatably supported around the body. The cam is configured to reciprocate the plungers in timed relation to sequentially draw fuel from the inlet passage into the central fuel chamber and alternately force fuel from the central fuel chamber to the outlet passage in response to rotation of the rotary cam. Materials of the cylinders and plungers are selected for extended wear under operation with gasoline fuel, which has relatively low lubricity and viscosity. A preferred embodiment includes paired small and larger diameter cylinders and pistons which are sequentially actuated in overlapping fashion to minimize pulsing of the pressurized fuel discharged from the pump into associated engine fuel lines.

These and other features and advantages of the invention will be more fully understood from the following description of certain specific embodiments of the invention taken together with the accompanying drawings.

DESCRIPTION OF THE PREFERRED EMBODIMENT

Figure 1:
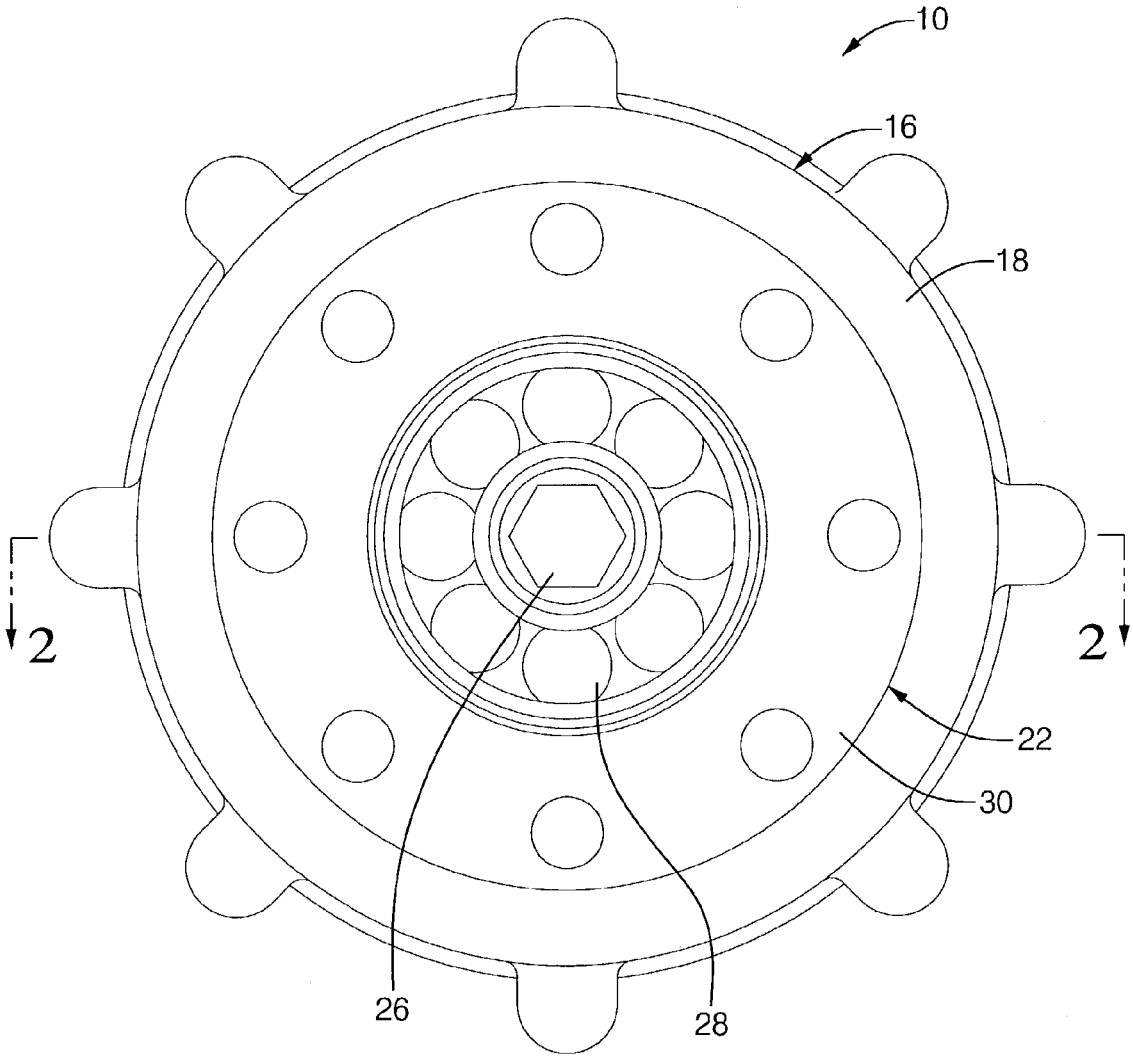
FIG. 1 is a drive end view of a radial cylinder piston fuel pump according to the invention.
Figure 2:
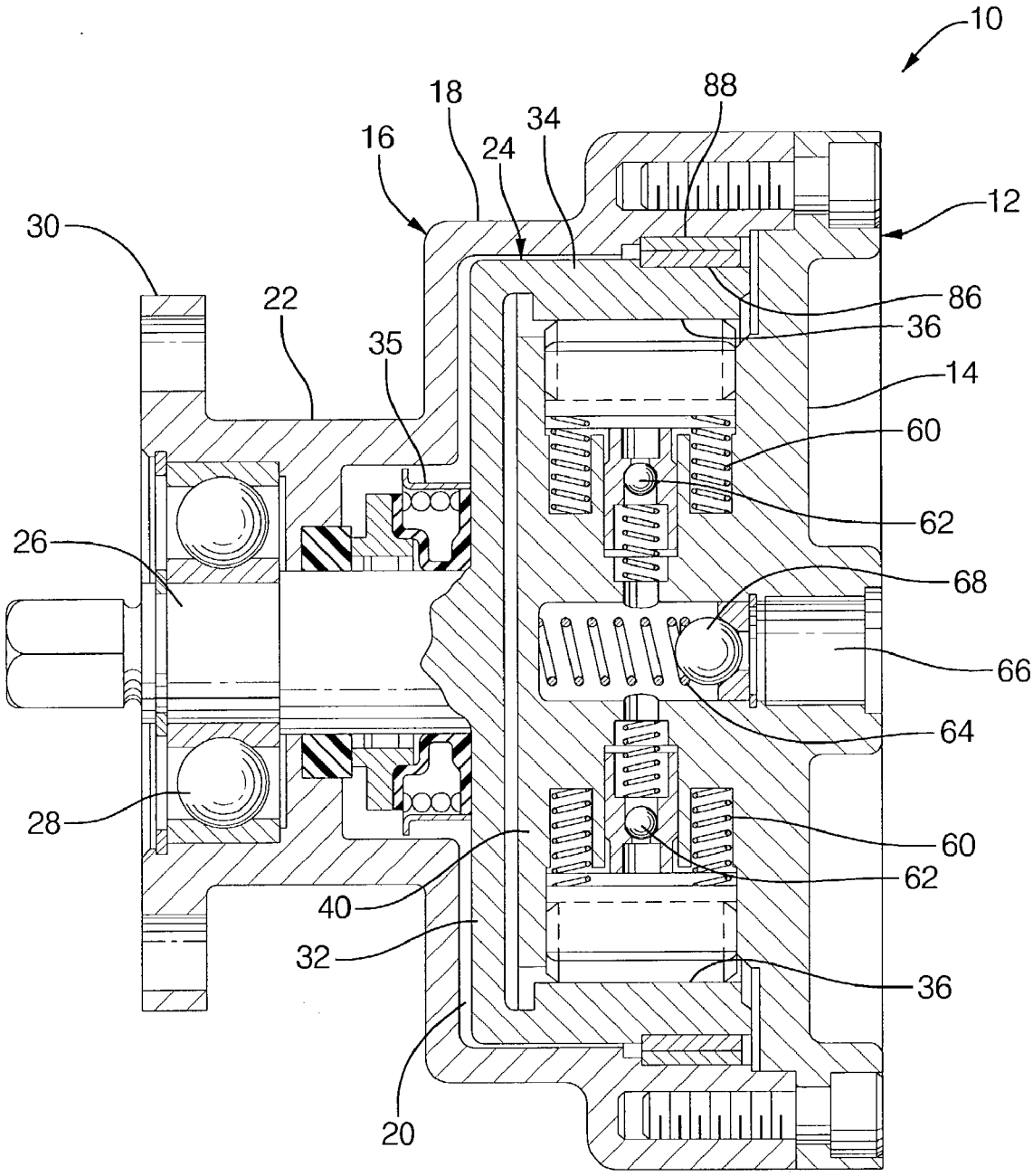
FIG. 2 is an axial cross-sectional view of the pump from the line 2—2 of FIG. 1.
Figure 3:
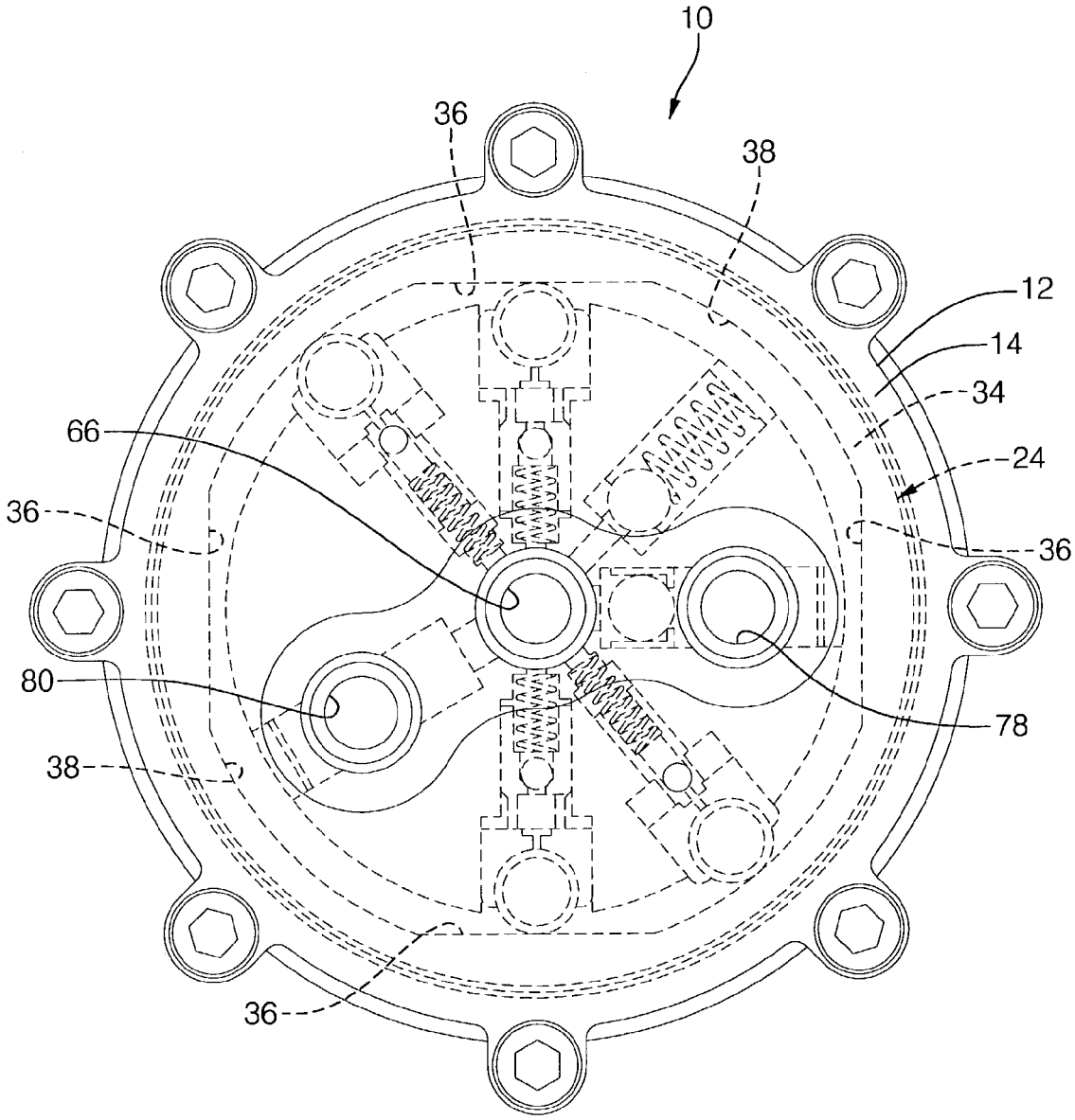
FIG. 3 is a view of the pump of FIG. 1 from the fuel connection end.

Referring now to the drawings in detail, numeral 10 generally indicates a radial piston fuel pump according to the invention. Pump 10 includes a stationary body 12 having an end portion 14 sealingly mounted to an enclosing housing 16. The housing includes a flared portion 18 defining a circular enclosure 20 and a flanged extension 22 defining a mounting portion.

The housing 16 rotatably supports a cam member 24 having a drive shaft 26 supported by a ball bearing 28 carried adjacent a mounting flange 30 on the extension 22. The drive shaft connects with a radial disk 32 supporting a cam ring 34 for rotation within the enclosure 20. A mechanical fuel seal 35 sealingly engages the disk 32 adjacent to the drive shaft 26.

The interior of the ring 34 is provided with four equiangularly spaced inwardly raised cam lobes 36 that extend inward from the otherwise circular inner surface 38 of the ring 34. The cam lobes are shown as flat surfaces but may be made with any desired configuration suitable for their subsequently described purpose.

Figure 4:
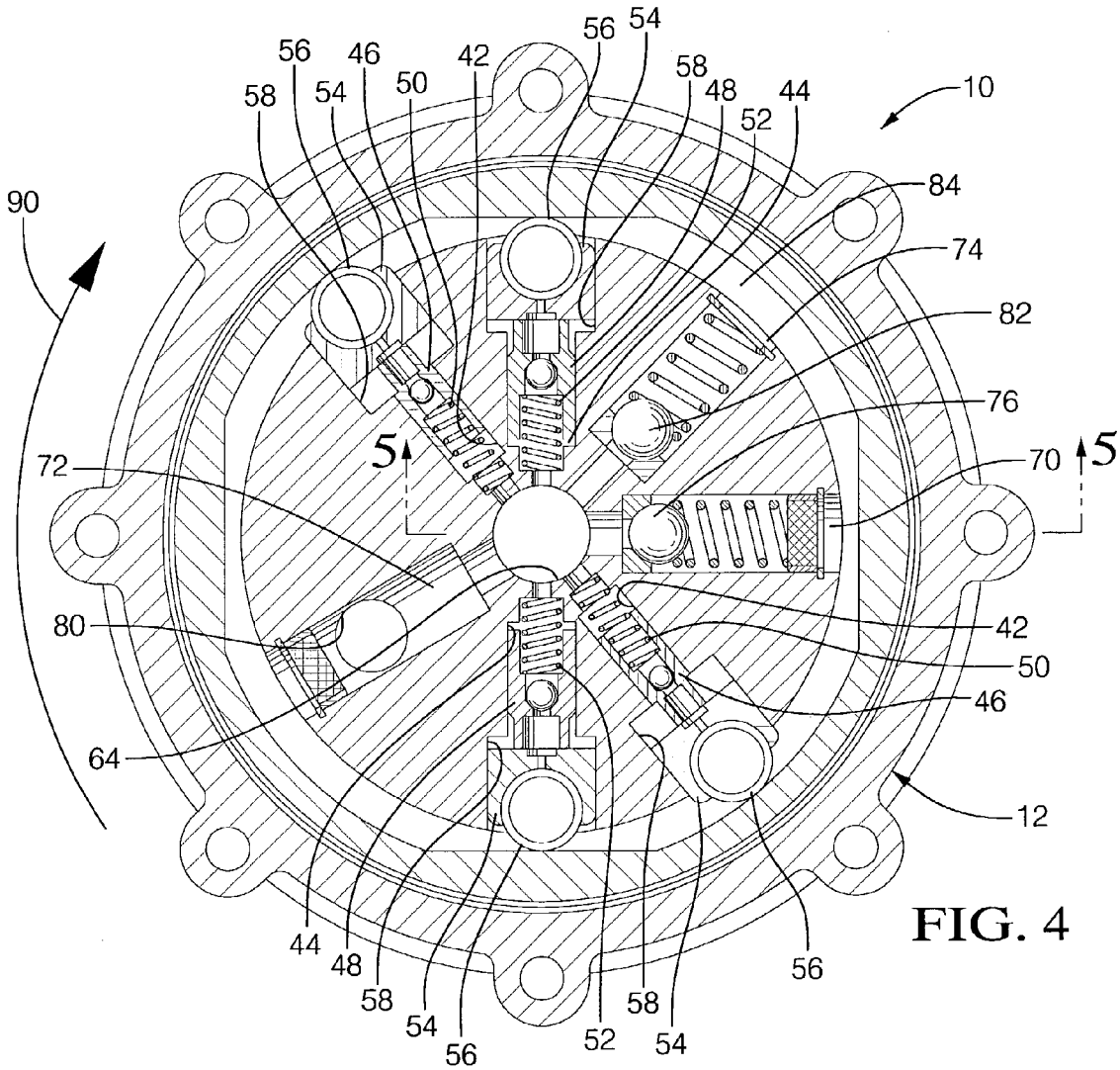
FIG. 4 is a radial cross-sectional view of the pump from the line 4—4 of FIG. 2.
Figure 5:
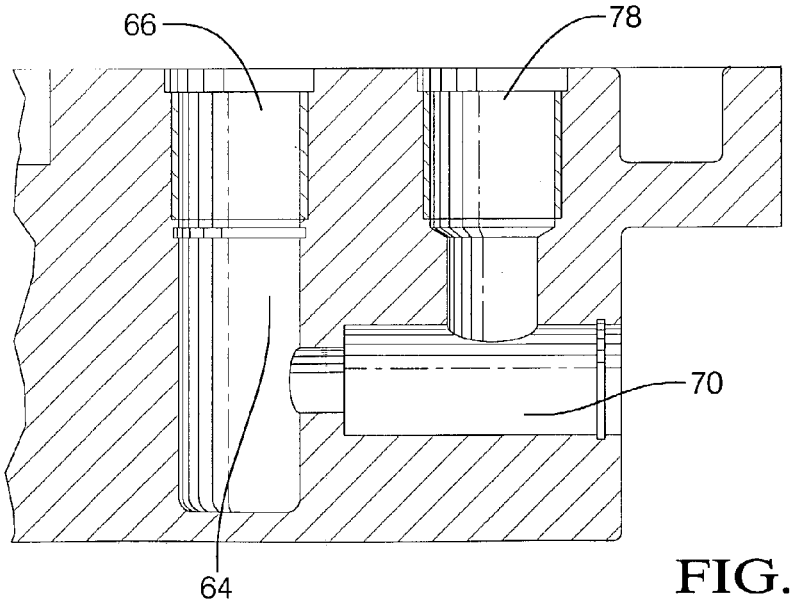
FIG. 5 is an enlarged cross-sectional view from the line 5—5 of FIG. 3.

A generally cylindrical portion 40 of the body 12 extends into the cam ring 34 within the circular enclosure 20 of the housing 16. Within the cylindrical portion 40, a plurality of radial bores or cylinders are provided. These include two pairs of pumping cylinders including two radially aligned small cylinders 42 and two radially aligned larger cylinders 44. The smaller cylinders are positioned at predetermined angles ahead of the larger cylinders in the direction of rotation of the cam ring (clockwise as shown in FIG. 4) to form related pairs of cooperating small and larger cylinders, which provide pressure pulse damping in a manner to be subsequently made clear.

Within the cylinders, 42, 44, suitably sized plungers 46, 48, respectively are reciprocably received. The plungers are biased outward by springs 50, 52 to engage cam followers including follower shoes 54 and follower rollers 56. The shoes 54 are received in follower slots or recesses 58 in the body 12 and the follower rollers 56 are carried for rotation in the shoes 54. Springs 60 urge the shoes outward to maintain the rollers against the interior surface of the cam ring 34. The interiors of the plungers are hollow to provide for radial inflow of excess fuel from the follower recesses. Ball check valves 62 are provided to prevent backflow of the fuel outward through the plungers.

The cylinders 42, 44 are open at their inner ends to an axially extending central fuel chamber 64 into which fuel is drawn through an inlet port 66 in the end portion 14 of the stationary body 12. A valve, such as a spring loaded inlet check valve 68 prevents return fuel flow out of the port 66.

Additional radial bores connecting with the central fuel chamber include an outlet passage 70, a spill passage 72 and an internal relief passage 74. The outlet passage 70 includes an outlet check valve 76 for preventing fuel return inflow and connects with an outlet port 78 opening axially through the body end portion 14 for connection to a fuel distribution line, not shown. The spill passage 72 connects with a spill port 80 opening axially through end portion 14 for connection with an external pressure control valve, not shown, to control fuel outlet pressure. The internal relief passage 74 includes a spring loaded pressure relief valve 82 that opens to relieve excessive fuel pressure through an open outer end of the passage 74 to a clearance volume 84 surrounding the cylindrical portion 40 of the body 12. High fuel pressure in this clearance volume may be relieved by return fuel flow through the plungers 46, 48 to the central fuel chamber 64.

In addition to the ball bearing 28 supporting the drive shaft 26 of the cam member 24, the cam ring 34 is directly supported by a journal sleeve 86 mounted on the cam ring and engaging an internal bearing sleeve 88 mounted in the housing 16 of the body 12. These bearing sleeves are preferably made of a hard wear resistant material, such as tungsten carbide, to provide long wear in spite of the poor lubricating characteristics of the gasoline fuel pressurized by the pump.

In operation of the fuel pump 10, the drive shaft 26 is driven by an external power source, such as the engine crankshaft, not shown. The shaft rotates the cam ring 34 clockwise in the direction of arrow 90 as shown in FIG. 4. During rotation, the inwardly raised cam lobes 36 sequentially engage first the cam follower rollers 56 of the smaller plungers 46 and second the rollers 56 of the larger plungers 48. Thus, the smaller plungers are first moved inward, forcing an initial volume of fuel from the fuel chamber 64 through the outlet port 78. As the smaller plungers begin to return, the larger plungers are actuated inward forcing a larger volume of fuel from chamber 64 through the outlet port 78. The overlapping fuel pulses provide an increasing flow rate for each pulse of fuel, so that the shock waves initiated by the fuel pulses are moderated.

Since the cam ring 34 is provided with four cam lobes 36, the plungers are each actuated four times for every revolution of the cam member. Thus the pump discharges four moderated sequential fuel pulses from both pairs of smaller and larger plungers with each turn of the pump drive shaft.

The normal fuel outlet pressure of the pump may be controlled by an external pressure regulator connected to the outlet of the pump or by means of an electronically controlled spill valve, not shown, connected to the optional spill port 80, which ports fuel directly from the cylinder volume, bypassing the inlet and outlet valves. A spill valve connected to the port 80, and additionally to the inlet supply line, thus provides a means for a variable volume of fuel to bypass the pumping event and pass through the spill valve to the inlet side of the pump. Functioning effectively as a variable displacement pump, a net energy savings can be realized. Implementation of a spill valve pressure control system would normally include a pressure feedback loop and may also require pump-cylinder position reference. If a maximum outlet pressure is exceeded, the internal pressure relief valve opens and discharges fuel into the clearance volume 84 within the cam ring 34 to reduce the pressure. If pressure build-up in the clearance volume 84 occurs, it is relieved by fuel flow through the plungers and back to the central fuel chamber 64. The shaft seal 35 acts to prevent loss of fuel through leakage past the drive shaft 26.

Figure 6:
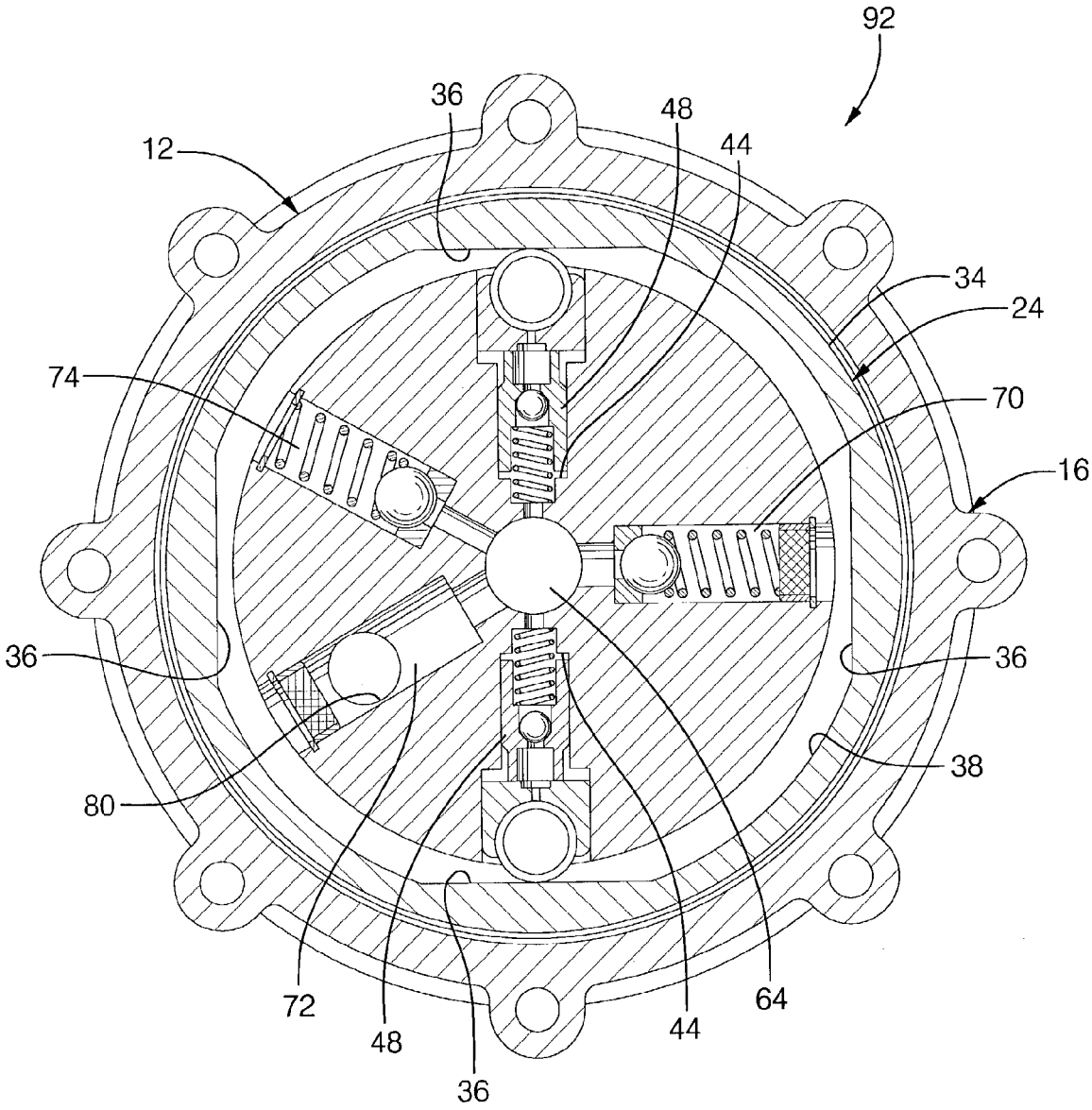
FIG. 6 is a view similar to FIG. 4 showing an alternative embodiment.

In FIG. 6 of the drawings, numeral 92 indicates a pump comprising an alternative embodiment of the invention wherein like numerals indicate components like those of the first embodiment. Pump 92 differs from pump 10 by the omission of the two smaller cylinders and plungers from the body 92 and by rearrangement of the radial bores. Thus, body 94 includes two larger cylinders 44 with plungers 48 aligned radially opposite one another. An outlet passage 70, spill passage 72 and relief passage 74 are also included as are a central fuel chamber 64 and an outlet port, not shown.

Because pump 92 is simplified by omission of the smaller cylinders, its operation is subject to increased pressure pulsations without the modulation from the more gradual pressure build-up provided by the smaller cylinders. However, in both cases, the pumps provide efficient high pressure output in a compact unit with a minimum of external leakage and with fuel connections limited to inlet and outlet ports in the housing end portion.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A fuel pump for supplying fuel at high fuel pressures, the pump comprising:

a stationary body having a plurality of radial cylinders connecting inwardly with a central fuel chamber and outwardly with follower recesses, the plurality of radial cylinders including a group of equiangularly spaced primary cylinders in the body, the plurality of radial cylinders including a group of secondary cylinders, each of the secondary cylinders paired with one of the primary cylinders spaced at a predetermined angle in advance of the secondary cylinders;

inlet and outlet passages communicating with the fuel chamber;

primary plungers reciprocable in the primary cylinders and outwardly engaging cam followers reciprocable in the follower recesses, the primary plungers actuated simultaneously by equiangularly spaced cam lobes;

secondary plungers reciprocable in the secondary cylinders and outwardly engaging cam followers reciprocable in the follower recesses, the secondary plungers actuated by the cam lobes upon rotation of the body at the predetermined angle following actuation of the primary plungers; and a rotary internal cam engaging the cam followers and rotatably supported around the body, the cam configured to reciprocate the primary and secondary plungers in timed relation to sequentially draw fuel from the inlet passage into the central fuel chamber and alternately force fuel from the central fuel chamber to the outlet passage in response to rotation of the rotary cam, wherein the primary plungers force a first volume of fuel from the central fuel chamber to the outlet passage, wherein the secondary plungers force a second volume of fuel from the central fuel chamber to the outlet passage, and wherein the first volume is not equal to the second volume.

2. A pump as in claim 1 including inlet and outlet valves on the inlet and outlet passages, at least one of the valves being a check valve permitting only one way fuel flow.

3. A pump as in claim 1 including a stationary housing enclosing and supporting the rotary cam for rotation in the housing.

4. A pump as in claim 1 including rollers on the cam followers and engaging the cam.

5. A pump as in claim 1 including springs biasing the cam followers into engagement with the cams.

6. A pump as in claim 1 wherein the plungers have minimal clearances within the cylinders to maximize pumping efficiency.

7. A pump as in claim 6 including a drain within the stationary body connected to carry away fuel passing through the plunger clearances.

8. A pump as in claim 1 wherein the rotary cam is configured to enclose the cylinders and form a rotary housing supported by bearings on the stationary body, the body including a mounting portion extending externally of the rotary housing.

9. A pump as in claim 1 wherein the first volume is less than the second volume.

10. A pump as in claim 1 wherein each of the primary and secondary cylinders include a diameter, wherein the diameter of the primary cylinders is less than the diameter of the second cylinders.

11. A pump as in claim 10 wherein the first volume is less than the second volume.

12. A fuel pump for supplying fuel at high fuel pressures, the pump comprising:

a stationary body;

at least one primary radial cylinder defined in the body connecting inwardly with a central fuel chamber and outwardly with a corresponding number of follower recesses;

at least one secondary radial cylinder defined in the body connecting inwardly with the central fuel chamber and outwardly with a corresponding number of follower recesses, each of the secondary cylinders paired with the primary cylinders, the primary cylinders spaced at a predetermined angle in advance of the secondary cylinders;

an inlet passage communicating with the fuel chamber;

an outlet passage communicating with the fuel chamber;

a primary plunger reciprocable in each of the primary cylinders and outwardly engaging cam followers reciprocable in the follower recess, the primary plunger actuated by equiangularly spaced cam lobes;

a secondary plunger reciprocable in each of the secondary cylinders and outwardly engaging cam followers reciprocable in the follower recess, the secondary plunger actuated by the cam lobes upon rotation of the body at the predetermined angle following actuation of the primary plunger; and a rotary internal cam engaging the cam followers and rotatably supported around the body, the cam configured to reciprocate the primary and secondary plungers in timed relation to sequentially draw fuel from the inlet passage into the central fuel chamber and alternately force fuel from the central fuel chamber to the outlet passage in response to rotation of the rotary cam, wherein the primary plunger forces a first volume of fuel from the central fuel chamber to the outlet passage, wherein the secondary plunger forces a second volume of fuel from the central fuel chamber to the outlet passage, and wherein the first volume is not equal to the second volume.

13. A fuel pump for supplying fuel at high fuel pressures, the pump comprising:

a stationary body having a plurality of radial cylinders connecting inwardly with a central fuel chamber and outwardly with follower recesses;

inlet and outlet passages communicating with the fuel chamber;

plungers reciprocable in the cylinders and outwardly engaging cam followers reciprocable in the follower recesses;

a rotary internal cam engaging the cam followers and rotatably supported around the body, the cam configured to reciprocate the plungers in timed relation to sequentially draw fuel from the inlet passage into the central fuel chamber and alternately force fuel from the central fuel chamber to the outlet passage in response to rotation of the rotary cam; and a spill passage connected to the central fuel chamber and formed in the stationary body.

14. A pump as in claim 13 further comprising an external pressure control valve connected to the spill passage for controlling fuel outlet pressure.

15. A fuel pump for supplying fuel at high fuel pressures, the pump comprising:

a stationary body having a plurality of radial cylinders connecting inwardly with a central fuel chamber and outwardly with follower recesses;

inlet and outlet passages communicating with the fuel chamber;

plungers reciprocable in the cylinders and outwardly engaging cam followers reciprocable in the follower recesses;

a rotary internal cam engaging the cam followers and rotatably supported around the body, the cam configured to reciprocate the plungers in timed relation to sequentially draw fuel from the inlet passage into the central fuel chamber and alternately force fuel from the central fuel chamber to the outlet passage in response to rotation of the rotary cam; and an internal relief passage connected to the central fuel chamber and formed in the stationary body.

16. A pump as in claim 15 further comprising a spring loaded pressure relief valve connected to the internal relief passage.

17. A pump as in claim 16 including a stationary housing enclosing and supporting the rotary cam for rotation in the housing, wherein a clearance volume is defined between the stationary housing and the rotary cam, and wherein the spring loaded pressure relief valve opens to relieve excess fuel pressure to the clearance volume.

* * * * *